US006446793B1

(12) United States Patent
Layshock

(10) Patent No.: US 6,446,793 B1
(45) Date of Patent: Sep. 10, 2002

(54) CONTAINER FOR CIGARETTES AND CIGARETTE LIGHTER

(76) Inventor: John M. Layshock, P.O. 8708, Jackson, WY (US) 83002

( * ) Notice: Subject to any disclaimer, the term of this patent is extended or adjusted under 35 U.S.C. 154(b) by 0 days.

(21) Appl. No.: 09/708,804

(22) Filed: Nov. 7, 2000

Related U.S. Application Data

(60) Provisional application No. 60/165,212, filed on Nov. 12, 1999.

(51) Int. Cl.[7] ..... B65D 85/10

(52) U.S. Cl. ..... 206/86; 206/85

(58) Field of Search ..... 206/85–90, 92, 206/235, 236, 242, 244, 246, 250, 252, 256–259, 266, 443; 220/523, 527, 528, 507; 431/253

(56) References Cited

U.S. PATENT DOCUMENTS

| | | | | | |
|---|---|---|---|---|---|
| 353,327 | A | * | 11/1886 | Randolph | 206/266 |
| 576,653 | A | * | 2/1897 | Bowlby | 206/92 |
| 1,053,758 | A | | 2/1913 | Turnbull | |
| 1,163,183 | A | * | 12/1915 | Stoll | 206/254 |
| 1,273,264 | A | | 7/1918 | Moran | |
| 1,293,197 | A | | 2/1919 | Rice | |
| 1,463,086 | A | | 7/1923 | Kelly | |
| 1,522,633 | A | | 1/1925 | Kister | |
| 1,587,468 | A | | 6/1926 | Burkey et al. | |
| 1,741,867 | A | | 12/1929 | Mara | |
| 1,768,064 | A | * | 6/1930 | Holben | 206/252 |
| 1,819,427 | A | * | 8/1931 | Maisto | 206/254 |
| 1,845,340 | A | | 2/1932 | Ritz Woller | |
| 1,851,057 | A | | 3/1932 | Picker | |
| 1,957,261 | A | * | 5/1934 | Gaxiola | 206/90 |
| 1,961,181 | A | | 6/1934 | von der Heydt | |
| 2,031,363 | A | | 2/1936 | Erikson | |
| 2,081,930 | A | | 6/1937 | Hoffman | |
| D140,571 | S | | 3/1945 | Musselman et al. | |
| D144,528 | S | | 4/1946 | Tupper | |
| 2,411,946 | A | | 12/1946 | Vogel | |
| D148,402 | S | | 1/1948 | Abbatiello | |
| D148,650 | S | | 2/1948 | Snodgrass | |
| 2,460,427 | A | | 2/1949 | Musselman et al. | |
| 2,483,304 | A | | 9/1949 | Vogel | |
| 2,727,547 | A | | 12/1955 | Moon | |
| 2,741,109 | A | | 4/1956 | Dupuis | |
| 4,207,976 | A | | 6/1980 | Herman | |
| RE31,076 | E | | 11/1982 | Herman | |
| D366,344 | S | | 1/1996 | Mak | |
| 5,558,217 | A | * | 9/1996 | Focke et al. | 206/87 |

* cited by examiner

*Primary Examiner*—Jim Foster
(74) *Attorney, Agent, or Firm*—Robert M. Hunter

(57) ABSTRACT

An apparatus for protecting a cigarette lighter and cigarettes from damage and wetting. A preferred embodiment of the apparatus comprises a body fitted with an insert that accommodates a disposable lighter and a number of cigarettes. A lid is provided that snaps onto the body to provide a waterproof seal between the body and the lid. In some embodiments, the body and the lid are injection molded of plastic as one piece and are connected by means of an integral hinge.

20 Claims, 6 Drawing Sheets

CONTAINER FOR CIGARETTES AND CIGARETTE LIGHTER

CROSS-REFERENCE TO RELATED APPLICATIONS

This application claims the benefit of U.S. Provisional Application No. 60/165,212, filed Nov. 12, 1999, the disclosure of which application is incorporated by reference as if fully set forth herein.

STATEMENT REGARDING FEDERALLY SPONSORED RESEARCH OR DEVELOPMENT

Not Applicable

BACKGROUND OF THE INVENTION

This invention relates to a means for keeping cigarettes, a cigarette lighter and/or other smoking materials dry and undamaged. In particular, it relates to a container for holding cigarettes or tobacco and a cigarette lighter that can be carried in the pocket of a user during the performance of a sporting, recreation, physical or social activity.

Cigarettes and cigarette lighters are well known. Individual cigarettes are fragile constructions that must be maintained in an undamaged and dry condition in order to function correctly. Similarly, cigarette lighters are susceptible to damage and can become unsafe or inoperable if roughly handled. This is particularly true for inexpensive disposable lighters. Such lighters are disclosed in U.S. Pat. Nos. 5,017,128 and 5,085,578, the disclosures of which patents are incorporated by reference as if fully set forth herein.

The background art is characterized by U.S. Pat. Nos. 1,053,758; 1,273,264; 1,293,197; 1,463,086; 1,522,633; 1,587,468; 1,741,867; 1,845,340; 1,51,057; 1,961,181; 2,031,363; 2,081,930; 2,411,946; 2,460,427; 2,483,304; 2,727,547; 2,741,109; 4,207,976; Re. 31,076; Des. 140,571; Des. 144,528; Des. 148,402; Des. 148,650; and Des. 366, 344; the disclosures of which patents are incorporated by reference as if fully set forth herein.

Turnbull in U.S. Pat. No. 1,053,758 discloses a waterproof container. This invention is limited in that packing in a seat and clamping members are required to seal the joint between the casing and its cover. Moreover, no means are provided for supporting cigarettes in the container body.

Moran in U.S. Pat. No. 1,273,264 discloses a cigarette and match case. This invention is limited in that a snap-on closure is required to seal the joint between the container and its cover. Moreover, no means are provided to organize the container's contents.

Rice in U.S. Pat. No. 1,293,197 discloses a cigarette case. This invention is limited in that it is not waterproof and in that a spring-pressed catch is required to fasten the lid on the body. Moreover, the device comprises an integral refillable lighter.

Kelly in U.S. Pat. No. 1,463,086 discloses a waterproof carrying case. This invention is limited in that a bail and a rubber gasket are required to seal the joint between the body and its cover. Moreover, no means are provided to organize the container's contents.

Kister in U.S. Pat. No. 1,522,633 discloses a waterproof cigarette container. This invention is limited in that wire bails and a rubber gasket are required to seal the joint between the vial and its lid. Moreover, no means are provided to organize the container's contents.

Burkey et al. in U.S. Pat. No. 1,587,468 discloses a cigarette case. This invention is limited in that a roller clamp is required to seal the joint between the body and its cover. Moreover, no means are provided for supporting cigarettes in the container body.

Mara in U.S. Pat. No. 1,741,867 discloses a combined cigarette case and lighter. This invention is limited in that it is not waterproof, is designed to accommodate an entire package of cigarettes and comprises an integral refillable lighter.

Woller in U.S. Pat. No. 1,845,340 discloses a combination cigarette case and lighter. This invention is limited in that it is not waterproof Moreover, the device comprises an integral refillable lighter.

Picker in U.S. Pat. No. 1,851,057 discloses a cigarette case. This invention is limited in that its cover it removable. Moreover, the device comprises an integral refillable lighter located in the middle of the container.

Von der Heydt in U.S. Pat. No. 1,961,181 discloses a carrying case. This invention is limited in that a cushion and tongues are required to seal the joint between the container and its lid. Moreover, no means are provided to organize the container's contents.

Erickson in U.S. Pat. No. 2,031,363 discloses a combination vanity case. This invention is limited in that a gasket in a channel is required to seal the joint between the body and its cover. Moreover, no means are provided for supporting cigarettes in the container body.

Hoffman in U.S. Pat. No. 2,081,930 discloses a waterproof container for bathers. This invention is limited in that a gasket in a channel and spring-loaded hooks or catches are required to seal the joint between the bottom portion and its cover. Moreover, no means are provided for supporting cigarettes in the container body.

Vogel in U.S. Pat. No. 2,411,946 discloses a container for cigarette packages or the like. This invention is limited in that it is not waterproof and is designed to accommodate an entire package of cigarettes. Moreover, the device is not designed to accommodate a lighter.

Vogel in U.S. Pat. No. 2,483,304 discloses a container. This invention is limited in that it is not waterproof and is designed to accommodate an entire package of cigarettes. Moreover, the device is not designed to accommodate a lighter.

Musselman et al. in U.S. Pat. No. 2,460,427 discloses a combined cigarette case and lighter. This invention is limited in that it is not waterproof and is designed to accommodate an entire package of cigarettes. Moreover, the device comprises an integral refillable lighter.

Moon, III, in U.S. Pat. No. 2,727,547 discloses a container. This invention is limited in that a strap connects the container and its cover. Moreover, no means are provided for supporting cigarettes in the container body.

Dupuis in U.S. Pat. No. 2,741,109 discloses a cigarette lighter. This invention is limited in that it is not waterproof Moreover, it comprises an integral refillable lighter.

Herman in U.S. Pat. Nos. 4,207,976 and Re. 31,076 discloses a cigarette package. This invention is limited in that it is not waterproof and cannot accommodate a lighter. Moreover, the bores within the body of the device hold each cigarette in a friction type fit and the device requires the user to store cigarette butts in it.

Musselman et al. in U.S. Pat. No. 140,571 discloses a combined cigarette and igniter case. This invention is limited in that it is not waterproof Moreover, no means are provided to organize the container's contents.

Tupper in U.S. Pat. No. Des. 144,528 discloses a combined cigarette and match case. This invention is limited in that the lid does not appear to be attached to the body of the device.

Abbatiello in U.S. Pat. No. Des. 148,402 discloses a leakproof container for a cigarette package. This invention is limited in that a wire bail and what appears to be a gasket are required to seal the joint between the container and its lid. Moreover, no means are provided to organize the container's contents.

Snodgrass in U.S. Pat. No. Des. 148,650 discloses a combined cigarette lighter and case. This invention is limited in that it is not waterproof. Moreover, the device comprises an integral refillable lighter.

Mak in U.S. Pat. No. Des. 366,344 discloses a waterproof cigarette case. This invention is limited in that it is not designed to accommodate a disposable lighter. Moreover, no means are provided to organize the container's contents.

BRIEF SUMMARY OF THE INVENTION

The invention is used to contain and to provide protection to smoking materials, e.g., one or more cigarettes or loose tobacco and a cigarette lighter. In a preferred embodiment, the invention is a waterproof container that holds up to five cigarettes and a disposable, flint and spark wheel lighter. In another preferred embodiment, the disposable lighter is a full-size or mini lighter manufactured by the BIC Corporation. In yet another preferred embodiment, the invention is used to provide protection to loose tobacco, a lighter and a smoking tool.

One advantage of the invention is that cigarettes and a cigarette lighter are kept dry in a watertight container in a potentially wet situation, for example, while fishing, hiking or skiing. Another advantage is that cigarettes and a cigarette lighter are protected from damage. Yet another advantage is that the lighter and the cigarettes are stored in a space-efficient manner and in a container having a smooth shape that fits into a shirt or pants pocket. A further advantage is that the smoker can limit the number of cigarettes available to him or her for smoking during a period of time or activity to the number that the device can hold, for example, five.

The invention is an apparatus for containing one or more cigarettes, a cigarette lighter and/or other smoking materials. In a preferred embodiment, the apparatus comprises a body with an opening that is fitted with an insert that holds a plurality of cigarettes and a cigarette lighter. In one embodiment, a lid is attached to the body by means of a hinge and snaps closed over the opening in the body in such a way that the top ends of the cigarettes and the top end of the lighter fit into the lid. In a preferred embodiment, the body and lid are produced by the plastic injection molding process as one piece (in one mold) with the body and lid connected via an integral tab, tail or hinge (e.g., a "living hinge") mechanism. The tab, tail or hinge mechanism operates to cause the lid to move (generally, to rotate or pivot) to a position that is adjacent to the body and clear of any flame produced by the lighter. In alternative embodiments, the lid is a separate component that is snapped onto the body covering the opening.

An insert is permanently snapped into the opening in the body during fabrication of the device. Holes in the insert provide support for (and generally restrict movement relative to the body of) the generally cylindrical cigarettes and for the lighter. In other embodiments, ribs molded into the interior of the body also provide support for the cigarettes and the lighter. In a preferred embodiment, the components of the device are plastic and produced by injection molding. In other embodiments, one or more of the components are comprised of wood, metal or other material.

In use, the invention is operated by holding the body in one hand and pulling on the lid causing the lid to rotate around a pivot point or zone provided by the hinge until the lid is clear of any flame that can be produced by the lighter. A cigarette is removed from the device and placed in the smoker's mouth. Holding the body in one hand, the smoker uses his or her thumb to manipulate the sparkwheel (or other ignition mechanism) of the lighter and the fuel release valve, causing the lighter to produce a flame. After the flame has been used to light the cigarette, the fuel release valve is allowed to close, extinguishing the flame. The lid is then rotated back over the hole in the body and latched into place in such a way that water cannot pass through the junction between the lid and the body when the device is submerged in water.

In broad terms, a preferred embodiment of the apparatus is comprised of a body having an opening, an insert fitted into the body through the opening and a lid for covering the opening. The lid may be a separate component that is snapped onto the body or it may be attached to the body by means of a tab, tail or hinge in such a way that it can be moved or pivoted to cover the opening. The insert is provided with at least one hole (and, preferably, a plurality of holes) which can accept at least one cigarette (and, preferably, a plurality of cigarettes). The insert is also provided with a hole which can accept a disposable cigarette lighter. In an alternative embodiment, the body is provided with ribs and/or stops integrally molded therein to provide further support to the cigarettes and the lighter.

Another preferred embodiment of the invention is a container for cigarettes and a cigarette lighter comprising a generally hollow body having an exterior surface and an opening, the exterior surface forming a female closure means. The container also comprises a generally hollow lid having an interior surface and an interior having a generally concave shape, the lid being connected to the body by means of a tab, tail or hinge that forms a living hinge mechanism, and the interior surface forming a male closure means that is engagable with said female closure means in an interference fit. The container further comprises an insert irreversibly snapped into the generally hollow body, the insert having a plurality of holes therein, one of the holes being configured to accept a disposable cigarette lighter with the ignition mechanism of the lighter being accessible to a user when the closure means are not engaged and the lid is pivoted away from the opening. In this embodiment, the other holes accommodate the upper ends of a plurality of tubular cavities, each of the tubular cavities having a closed lower end. In this embodiment, one of the cavities is configured to hold loose tobacco and another is configured to hold a tobacco bat or pipe. The cavity that is configured to hold loose tobacco is adapted to allow the tobacco to be poured out of the cavity, e.g., into a pipe. In a preferred embodiment, the upper end of this cavity protrudes above the upper surface of the insert and forms a spout to facilitate pouring of the tobacco.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the inventive concept. Thus, the following drawings and description are to be regarded as illustrative in nature and not restrictive.

BRIEF DESCRIPTION OF THE SEVERAL VIEWS OF T HE DRAWINGS

The features of the invention will be better understood by reference to the accompanying drawings which illustrate presently preferred embodiments of the invention. In the drawings.

Figure 1:
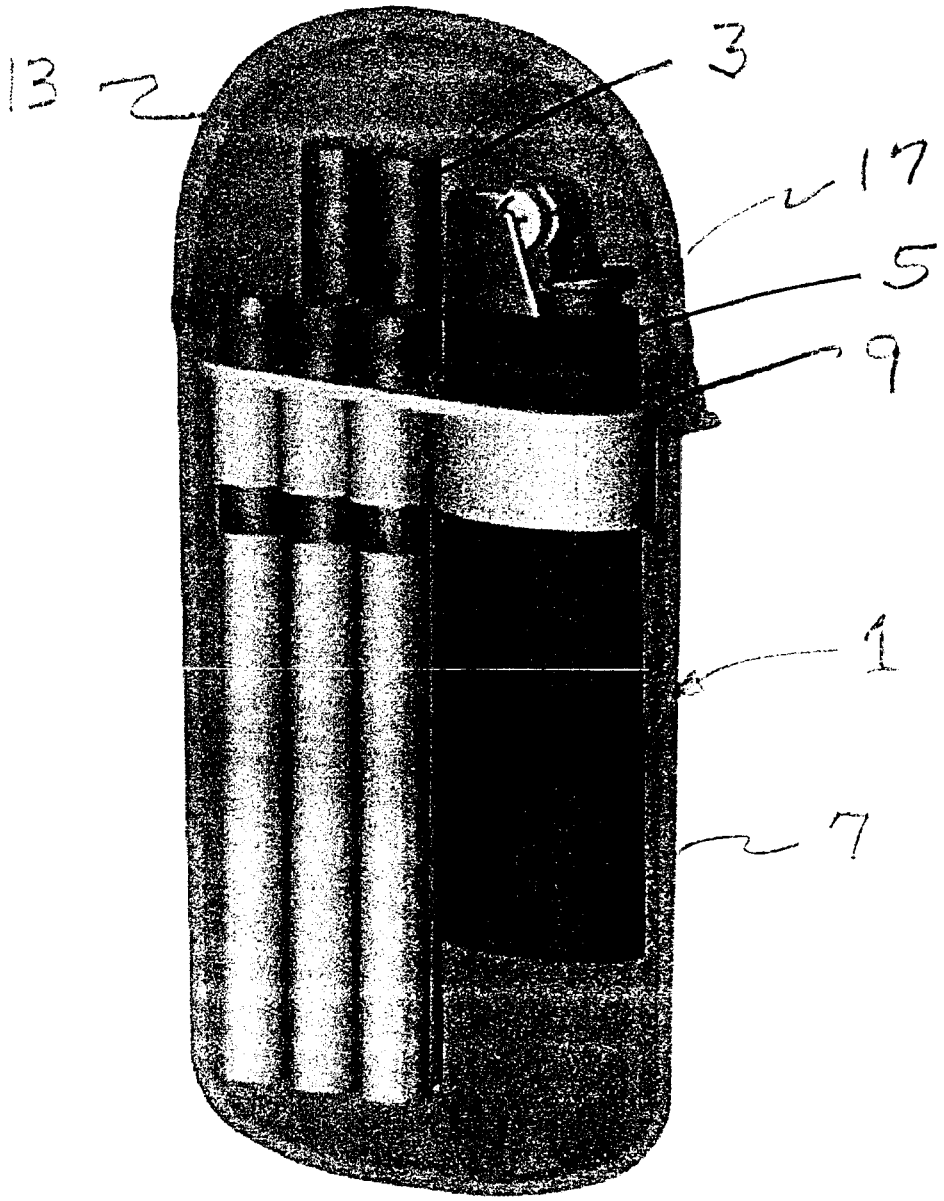
FIG. 1 is a three-dimensional view of a preferred embodiment of the invention holding cigarettes and a cigarette lighter.

The following reference numerals are used to indicate the parts and environment of the invention on the drawings:

1 container
3 cigarettes
5 cigarette lighter
7 body
9 opening
11 insert
13 lid
15 tab, tail or hinge
17 end
21 longitudinal ribs
23 first stops
25 second stops
26 third stop
27 non-circular hole
29 circular holes
31 tubular sleeves
33 ramp-like bottom surface
35 flap-like top surface
47 tobacco chamber
49 smoking tool chamber
51 spout
53 male latch member
55 female latch member
57 arms
59 grooves

DETAILED DESCRIPTION OF THE INVENTION

Referring to FIG. 1, a preferred embodiment of container 1 for cigarettes and a cigarette lighter, termed a "Sports Smoker™," is illustrated. In this embodiment, container 1 is fabricated from a transparent or translucent material such as polycarbonate or polypropylene which allows cigarettes 3 and cigarette lighter 5 to be seen through the walls of container 1. The corners of container 1 are rounded and it is as small and thin as possible while serving its purpose.

Container 1 is comprised of body 7 having opening 9 into which insert 11 is fitted. In a preferred embodiment, opening 9 in body 7 and insert 11 are configured to allow insert 11 to snap into opening 9 during assembly of container 1. In an alternative embodiment, insert 11 is fastened into opening 9 by another conventional means, such as gluing or welding.

In this embodiment, lid 13 is attached to body 7 by hinge 15. In a preferred embodiment, hinge 15 is configured to cause lid 13 to pivot 90 degrees or more when a user urges end 17 of lid 13 to pivot away from body 7.

In an alternative embodiment, only a single line of circular holes 29 are provided, thus allowing container 1 to be thinner than the embodiment shown in FIG. 1. In yet another embodiment, fewer than five holes 29 are provided. In a further embodiment, non-circular hole 27 has a different shape (which may or may not be circular) to accommodate a lighter having another cross sectional shape than that shown in FIG. 1.

Figure 2:
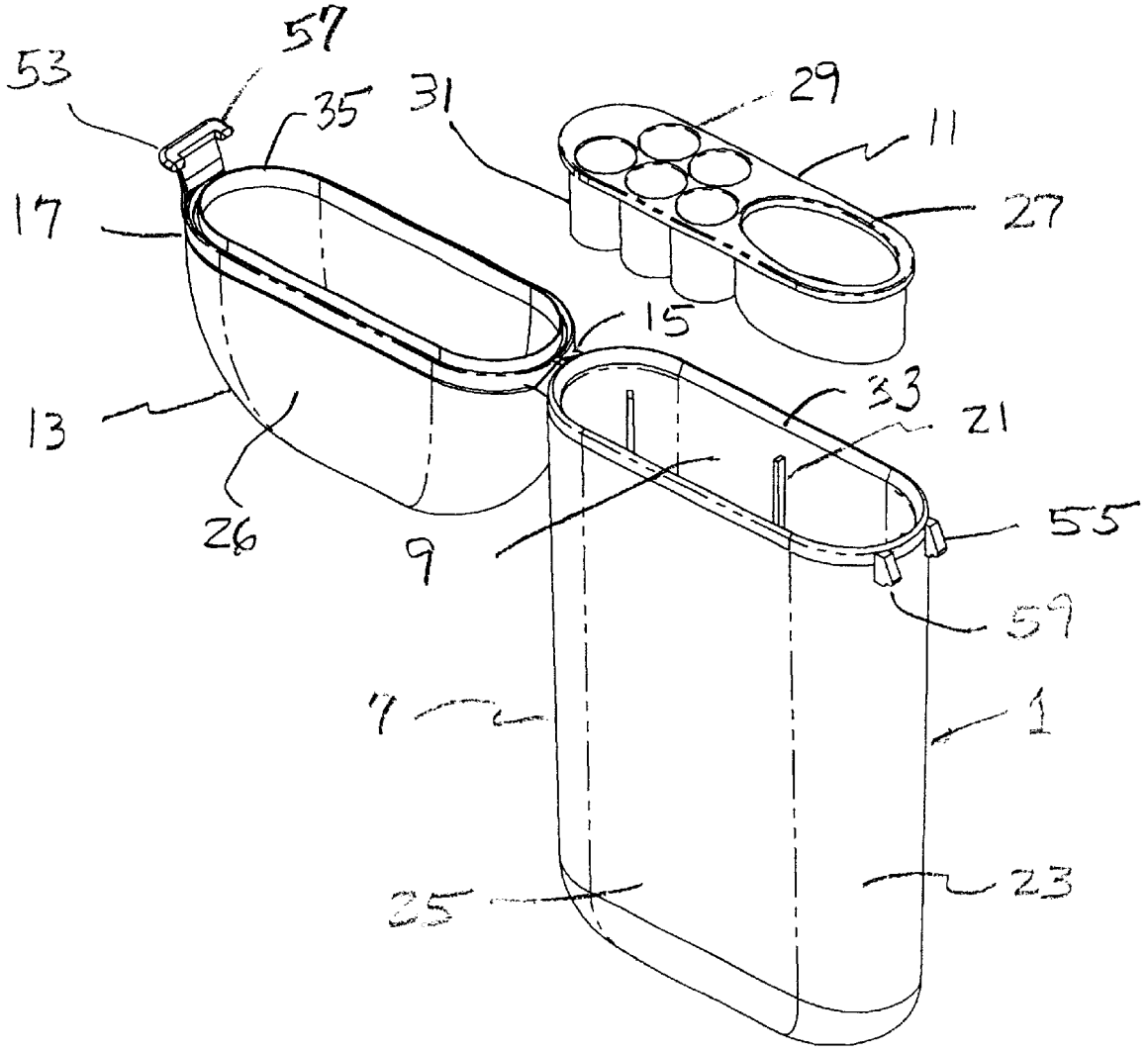
FIG. 2 is a three-dimensional, exploded view of a preferred embodiment of the invention.

Referring to FIG. 2, a second preferred embodiment of container 1 is presented. In this embodiment, insert 11 is configured to accommodate five cigarettes 3 of uniform length. Body 7 is shown to comprise opening 9, longitudinal ribs 21 and first stops 23 and second stops 25. Longitudinal ribs 21 serve to guide the cigarettes (not shown) and the cigarette lighter (not shown) into body 7 and to hold them in place. First stops 23 act to stop the downward movement of the lighter as it is installed in body 7. Second stops 25 act to stop the downward movement of the cigarettes as they are placed in body 7. Third stop 26 acts to hold lighter 5 in position when lid 13 is latched on body 7, i.e. to prevent lighter 5 from moving up into lid 13.

Insert 11 is configured to snap into opening 9 of body 7. The outer surface along the circumference of insert 11 and the inner surface along the circumference of opening 9 are configured to form a locking snap arrangement. In a preferred embodiment, certain of longitudinal ribs 21 prevent insert 11 from moving too far into body 7. Insert 11 is further provided with non-circular hole 27 into which a cigarette lighter can be inserted and with a plurality of circular holes 29, each of which can accept a cigarette. In a preferred embodiment, one of a plurality of tubular sleeves 31 is formed on the bottom side of insert 11, beneath each of the plurality of circular holes 29. Tubular sleeves 31 serve to spread lateral forces imposed on the cigarettes to a larger portion of the surface of each cigarette, thus protecting the relatively fragile cigarettes.

Figure 3:
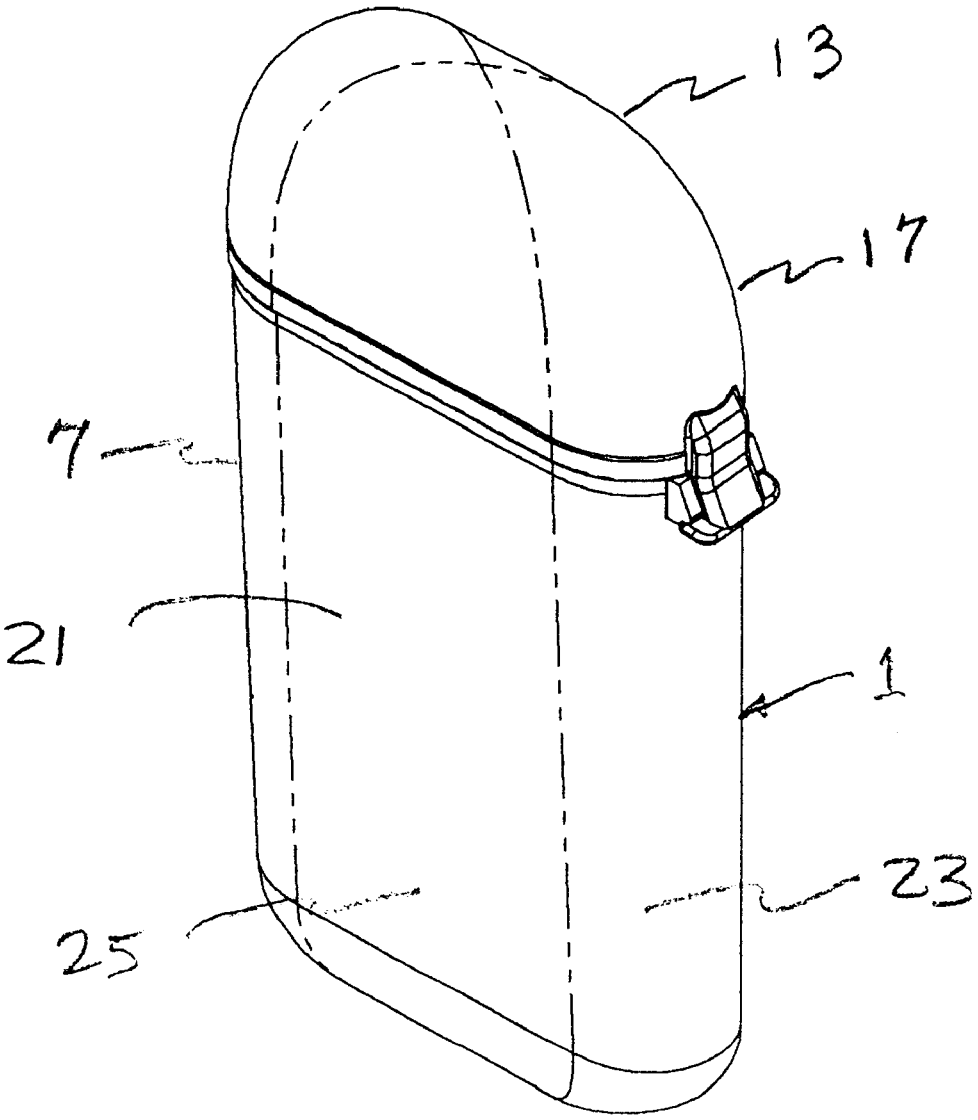
FIG. 3 is a three-dimensional view of the assembled embodiment of FIG. 2.

As shown in FIG. 3, in this embodiment, lid 13 is latched onto body 7 by means of male latch member 53 formed on lid 13 and female latch member 55 formed on body 7. The concave shape of lid 13 provides room to accommodate the top of the cigarette and the top of the lighter when they are placed in body 7. In a preferred embodiment, ramp-like top surface 33 of body 7 and flap-like bottom surface 35 of lid 13 are configured to provide a waterproof seal when lid 13 is snapped on to body 7. The waterproof seal may be provided in any conventional way. In a preferred embodiment, ramp-like top surface 33 of body 7 and flap-like bottom surface 35 of lid 13 are configured to press against one another with sufficient force to prevent water from flowing between them when lid 13 is snapped on to body 7.

In an alternative embodiment (not shown), body 7 is fabricated from a relatively stiff material (relative to the stiffness of the material used to fabricate lid 13) that causes opening 9 to maintain its shape when transverse forces are imposed upon it. Lid 13, on the other hand, is fabricated from a relatively pliable material that stretches as lid 13 is snapped over the opening in body 7. In another alternative embodiment, body 7 is fabricated from a relatively pliable material and lid 13 is fabricated from a relatively stiff material, and lid 13 is snapped into opening 9 of body 7. In other embodiments, a Tupperware™ style closure is provided.

Figure 4:
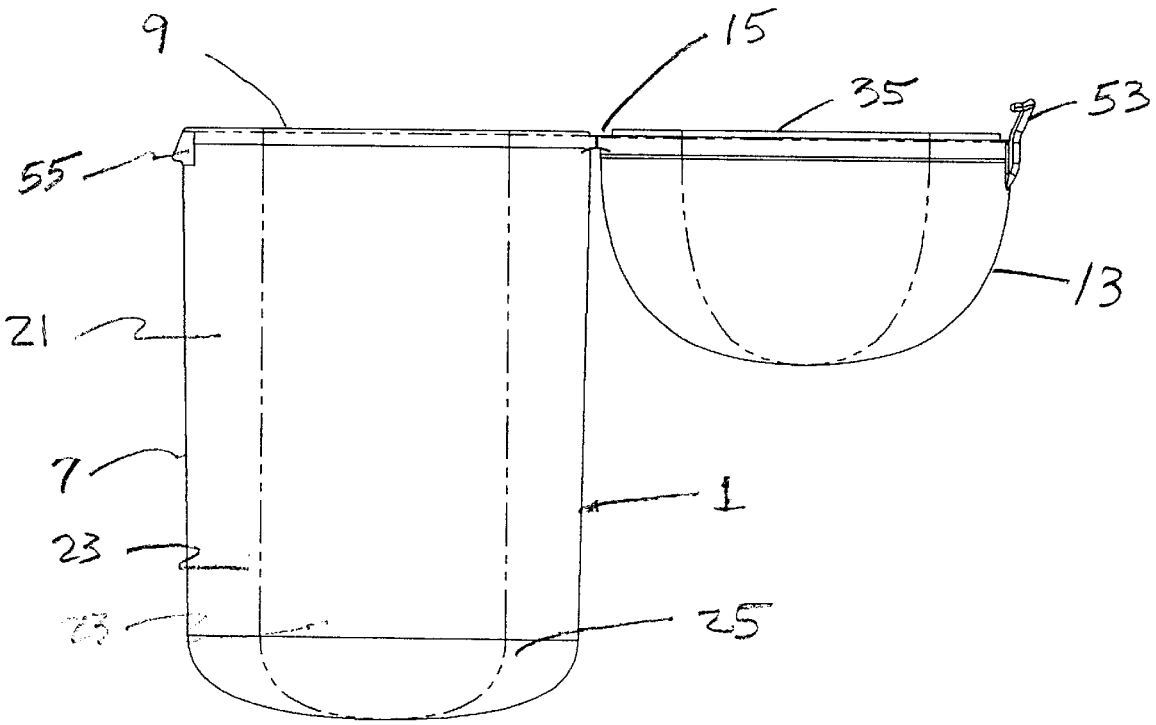
FIG. 4 is an elevation view of an embodiment of the body and lid that have been molded as one piece.

Referring to FIG. 4, an alternative view is presented of the preferred embodiment of container 1 that is presented in FIG. 3. In this view, insert 11 is snapped into body 7 and lid 13 is snapped on to body 7. The interior surfaces of body 7 and lid 13 are tapered in such a way as to allow the components to be easily ejected from the injection mold or molds used to form them.

In this embodiment, body 7 is attached to lid 13 by means of hingel 5. Hinge 15 is a thin piece of plastic that connects body 7 and lid 13. Hinge 15 is bent when lid 13 is rotated about 180 degrees to snap it on body 7. In an preferred embodiment, the hinge used is similar to those used on shampoo containers.

Figure 5:
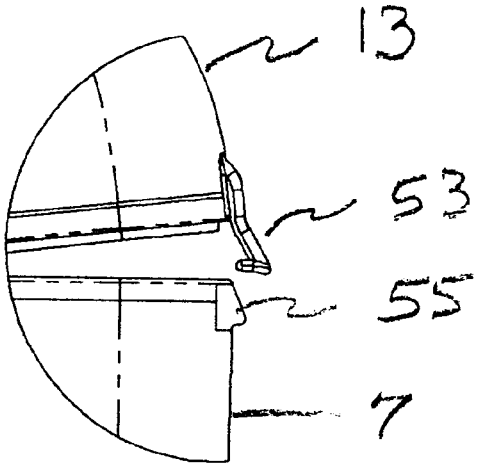
FIG. 5 is an enlarged detail view of the body portion of the latch mechanism presented on FIG. 4.

Referring to FIG. 5, a detailed view is presented of a latch that holds lid 13 on body 7 of the embodiment shown in FIG. 4. The latch is comprised of male latch member 53 that is formed on lid 13 and female latch members 55 that are formed on body 7. The male latch member 53 comprises two arms 57, with each arm 57 snapping into a groove 59 in the bottom of one of the female latch members 55.

Figure 6:
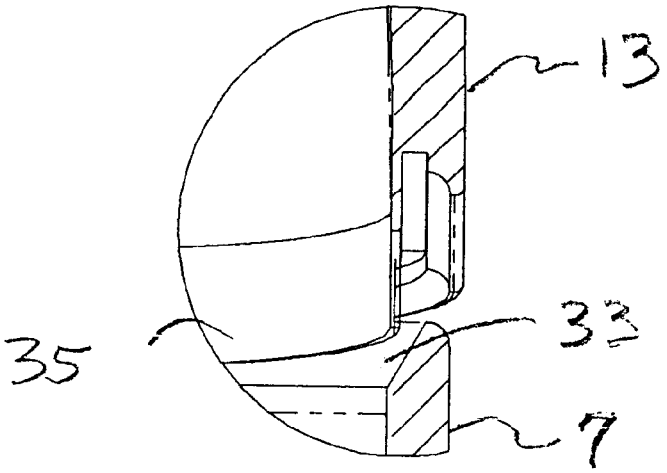
FIG. 6 is an enlarged detail view of the lid portion of the waterproof seal mechanism presented on FIG. 4.

Referring to FIG. 6, a detailed view is presented of the lid portion and the body portion of the waterproof seal between body 7 and lid 13 of the embodiment shown in FIG. 5. Ramp-like top surface 33 of body 7 provides a surface against which flap-like bottom surface 35 presses when lid 13 latched down on body 7 to close container 1.

Figure 7:
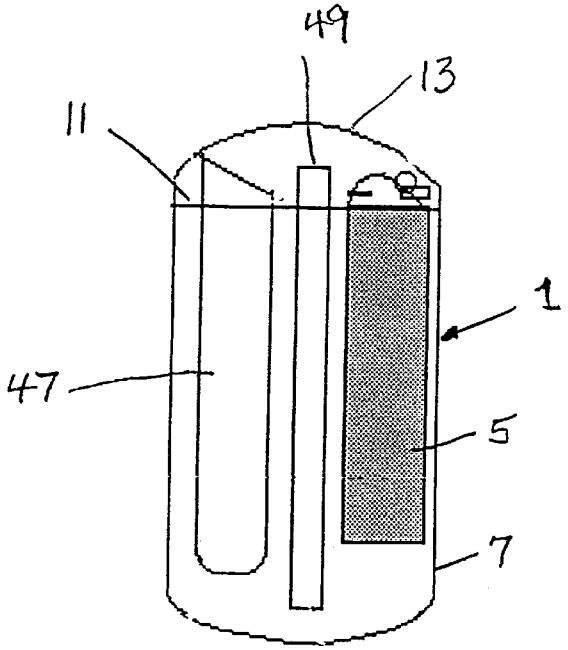
FIG. 7 is an elevation view of another preferred embodiment of the invention.
Figure 8:
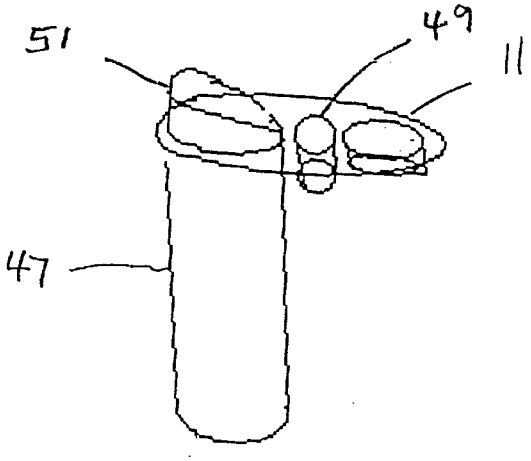
FIG. 8 is a detail view of another preferred embodiment of the insert.

Referring to FIG. 7, an elevation view of another preferred embodiment of the invention is shown. In this embodiment, the holes in the insert other than the hole that accommodates the lighter accommodate the upper ends of a plurality of tubular cavities or chambers, each of the tubular cavities or chambers having a closed lower end. In this embodiment, one of the cavities or chambers, tobacco chamber 47 is configured to hold loose tobacco and the other, smoking tool chamber 49 is configured to hold a smoking tool, e.g, a pipe or tobacco bat. As shown in FIG. 8, tobacco chamber 47 is adapted to allow the tobacco to be poured out of the chamber, e.g., into a pipe. In a preferred embodiment, the upper end of tobacco chamber 47 protrudes above the upper surface of the insert and forms spout 51 to facilitate pouring of the tobacco. With this embodiment, the holes in insert 11 can be aligned, thus allowing body 7 to be thinner in the dimension perpendicular to the line of holes.

The best mode of the invention involves injection molding of the components of container 1 with body 7 and lid 13 being molded as one piece with a hinge being formed between body 7 and lid 13. The best mode also involves providing an interference fit between a surface on body 7 and a surface on lid 13 so as to form a watertight seal between the two parts.

Operation of the invention involves holding body 7 in one hand pushing upward on lid 13 relative to body 7 with the other hand to open container 1. When container 1 is open, lighter 5 is installed in body 7 and cigarettes 3 are placed in body 7. Container 1 is then closed by snapping lid 13 on to body 7. When the user wishes to smoke a cigarette, the latch is unlatched and lid 13 is again snapped open and is prevented from being lost by the presence of tab 15. A cigarette is then removed from container 1 and placed in the mouth of the user. While lid 13 is still in an open position, the user grasps body 7 in the palm of one hand and uses his/her thumb to activate lighter 5 with which the cigarette is ignited. After the cigarette is ignited, the user allows the fuel valve on the lighter to close, thus extinguishing the lighter flame. The user then rotates lid 13 back into a closed position and latches the male and female latch members.

Many variations of the invention will occur to those skilled in the art. Some variations include injection molded or carved components. Other variations call for accommodation of a variety of lighter types, including an integral lighter. All such variations are intended to be within the scope and spirit of the invention.

What is claimed is:

1. An apparatus comprising:

a body having an interior and an opening having a first end and a second end;

an insert fitted into said interior, said insert being configured to support a plurality of cigarettes in sleeves and to support a disposable cigarette lighter adjacent said first end; and a lid attached to said body adjacent said second end by means of a hinge and configured to be snapped over said opening to form a waterproof seal between said body and said lid;

wherein said hinge is configured to cause said lid to pivot away from said opening when said lid is not snapped over said opening, thereby positioning said lid away from a flame produced by said lighter; and wherein said body has an interior surface, a top surface, an opening and a longitudinal axis, a plurality of longitudinal ribs being formed in said interior surface generally parallel to said longitudinal axis, each of said longitudinal ribs having a top that terminates below said opening, said interior surface supporting a first stop and a second stop, and said top surface being ramp like.

2. An apparatus comprising:

a body having an interior and an opening having a first end and a second end;

an insert fitted into said interior, said insert being configured to support a plurality of cigarettes in sleeves and to support a disposable cigarette lighter adjacent said first end; and a lid attached to said body adjacent said second end by means of a hinge and configured to be snapped over said opening to form a waterproof seal between said body and said lid;

wherein said hinge is configured to cause said lid to pivot away from said opening when said lid is not snapped over said opening, thereby positioning said lid away from a flame produced by said lighter;

wherein said body has an interior surface, a top surface, an opening and a longitudinal axis, a plurality of longitudinal ribs being formed in said interior surface generally parallel to said longitudinal axis, each of said longitudinal ribs having a top that terminates below said opening, said interior surface supporting a first stop and a second stop, and said top surface being ramp like; and wherein said insert rests on said tops, said insert comprising a plurality of tubular sleeves and a planar member having a plurality of holes, each of said holes having a center, one of said holes being non-circular in shape and being configured to accept a disposable cigarette lighter having a bottom that rests on said first stop and the remainder of said holes each being circular in shape and being configured to accept a cigarette having an end that rests on said second stop, each of said tubular sleeves extending below each of said circular holes, and said planar member having a circumferential edge, said circumferential edge being configured to permanently snap into said opening.

3. An apparatus comprising:

a body having an interior and an opening having a first end and a second end;

an insert fitted into said interior, said insert being configured to support a plurality of cigarettes in sleeves and to support a disposable cigarette lighter adjacent said first end; and a lid attached to said body adjacent said second end by means of a hinge and configured to be snapped over said opening to form a waterproof seal between said body and said lid;

wherein said hinge is configured to cause said lid to pivot away from said opening when said lid is not snapped over said opening, thereby positioning said lid away from a flame produced by said lighter; and wherein said body has an interior surface, a top surface, an opening and a longitudinal axis, a plurality of longitudinal ribs being formed in said interior surface generally parallel to said longitudinal axis, each of said longitudinal ribs having a top that terminates below said opening, said interior surface supporting a plurality of first stops and a second stop, and said top surface being ramp like.

4. An apparatus comprising:

a body having an interior and an opening having a first end and a second end;

an insert fitted into said interior, said insert being configured to support a plurality of cigarettes in sleeves and to support a disposable cigarette lighter adjacent said first end; and a lid attached to said body adjacent said second end by means of a hinge and configured to be snapped over said opening to form a waterproof seal between said body and said lid; and wherein said hinge is configured to cause said lid to pivot away from said opening when said lid is not snapped over said opening, thereby positioning said lid away from a flame produced by said lighter; and wherein said body has an interior surface, a top surface, an opening and a longitudinal axis, a plurality of longitudinal ribs being formed in said interior surface generally parallel to said longitudinal axis, each of said longitudinal ribs having a top that terminates below said opening, said interior surface supporting a first stop and a plurality of second stops, and said top surface being ramp like.

5. An apparatus comprising:

a body having an interior and an opening having a first end and a second end;

an insert fitted into said interior, said insert being configured to support a plurality of cigarettes in sleeves and to support a disposable cigarette lighter adjacent said first end;

a lid attached to said body adjacent said second end by means of a hinge and configured to be snapped over said opening to form a waterproof seal between said body and said lid;

wherein said hinge is configured to cause said lid to pivot away from said opening when said lid is not snapped over said opening, thereby positioning said lid away from a flame produced by said lighter;

wherein said body has an interior surface, a top surface, an opening and a longitudinal axis, a plurality of longitudinal ribs being formed in said interior surface generally parallel to said longitudinal axis, each of said longitudinal ribs having a top that terminates below said opening, said interior surface supporting a first stop and a second stop, and said top surface being ramp like;

wherein said insert rests on said tops, said insert comprising a plurality of tubular sleeves and a planar member having a plurality of holes, each of said holes having a center, one of said holes being non-circular in shape and being configured to accept a disposable cigarette lighter having a bottom that rests on said first stop and the remainder of said holes each being circular in shape and being configured to accept a cigarette having an end that rests on said second stop, each of said tubular sleeves extending below each of said circular holes, and said planar member having a circumferential edge, said circumferential edge being configured to permanently snap into said opening; and wherein the centers of said holes are positioned along a line.

6. A container for cigarettes and a cigarette lighter comprising:

a body having an interior surface, an exterior surface, a top surface, an opening and a longitudinal axis, said interior surface supporting a plurality of longitudinal ribs fixed thereto generally paralleling said longitudinal axis, each of said plurality of longitudinal ribs having a top that terminates below said opening, said interior surface supporting a first stop and a second stop, said top surface being ramp like, and said exterior surface supporting female latch members;

an insert resting on said tops, said insert comprising a plurality of tubular sleeves and a planar member having a plurality of holes, one of said holes being configured to accept a disposable cigarette lighter having a bottom that rests on said first stop and other of said holes each being generally circular in shape and being configured to accept a cigarette having an end that rests on said second stop, each of said tubular sleeves extending below each of said circular holes, and said planar member having a circumferential edge, said circumferential edge being configured to permanently snap into said opening; and a lid connected to said body by means of a hinge, said hinge being biased to normally pivot said lid away from said opening, said lid having a male latch member that is configured to be releasably and snugly snapped into said female latch members, thereby providing a waterproof seal between said body and said lid.

7. The container for cigarettes and a cigarette lighter of claim 6 further comprising:

a disposable cigarette lighter mounted in said body.

8. The container for cigarettes and a cigarette lighter of claim 6 further comprising:

a cigarette supported in at least one other hole.

9. The container for cigarettes and a cigarette lighter of claim 6 wherein each of said other holes and each of said associated tubular sleeves is configured to accept and support a cigarette with one end of each cigarette protruding out of each hole and into said interior when said lid is snapped onto said body over said opening.

10. The container for cigarettes and a cigarette lighter of claim 6 wherein said insert is configured to accept up to five cigarettes.

11. The container for cigarettes and a cigarette lighter of claim 6 wherein said longitudinal ribs are configured to guide said cigarettes and said cigarette lighter into said body and to hold them in place.

12. The container for cigarettes and a cigarette lighter of claim 6 wherein said cigarette lighter rests on said first stop and said cigarettes rest on said second stop.

13. A container for cigarettes and a cigarette lighter comprising:

a generally hollow body having an exterior surface and an opening, said exterior surface forming a female closure means;

a generally hollow lid having an interior surface and an interior having a generally concave shape, said lid being connected to said body by means of a tab, tail or hinge that forms a living hinge mechanism, and said interior surface forming a male closure means that is engagable with said female closure means; and an insert irreversibly snapped into said generally hollow body, said insert having a plurality of holes therein, one of said holes being configured to accept a disposable cigarette lighter with the ignition mechanism of said lighter accessible to a user when said closure means are not engaged and said lid is pivoted away from said opening and with the other holes accommodating the upper ends of a plurality of tubular chambers, each of said tubular chambers also having a closed lower end;

wherein one of said chambers has a spout and is configured to hold loose tobacco and another is configured to hold a smoking tool.

14. The container for cigarettes and a cigarette lighter of claim 13 wherein said body and said lid are fabricated from a transparent or translucent material.

15. The container for cigarettes and a cigarette lighter of claim 13 wherein said hinge is configured to cause said lid to pivot 90 degrees or more when a user urges said lid to pivot away from said opening.

16. The container for cigarettes and a cigarette lighter of claim 13 further comprising:

a disposable cigarette lighter.

17. The container for cigarettes and a cigarette lighter of claim 13 wherein said insert is secured in said body by means of a locking snap mechanism.

18. The container for cigarettes and a cigarette lighter of claim 13 wherein a plurality of longitudinal ribs are formed on the inside surface of said body, at least some of which ribs serve to prevent said insert from moving too far into said body.

19. The container for cigarettes and a cigarette lighter of claim 13 wherein the ignition mechanism is located adjacent one end of said opening and said living hinge is located adjacent another end of said opening.

20. An apparatus comprising:

a body having an interior and an opening having a first end and a second end;

an insert fitted into said interior, said insert being configured to support a plurality of cigarettes in sleeves and to support a disposable cigarette lighter adjacent said first end; and a lid attached to said body adjacent said second end by means of a hinge and configured to be snapped over said opening to form a waterproof seal between said body and said lid;

wherein said hinge is configured to cause said lid to pivot away from said opening when said lid is not snapped over said opening, thereby positioning said lid away from a flame produced by said lighter;

wherein said body has an interior surface, a top surface, an opening and a longitudinal axis, a plurality of longitudinal ribs being formed in said interior surface generally parallel to said longitudinal axis, each of said longitudinal ribs having a top that terminates below said opening, said interior surface supporting a first stop and a second stop, and said top surface being ramp like; and wherein said body has female latch members and lid has a male latch member that is configured to be releasably and snugly snapped into said female latch members, thereby providing a waterproof seal between said body and said lid.

* * * * *